US009267338B1

(12) United States Patent
LeBlanc et al.

(10) Patent No.: US 9,267,338 B1
(45) Date of Patent: Feb. 23, 2016

(54) IN-WELL DISCONNECT TOOL

(71) Applicant: Coiled Tubing Rental Tools, Inc., Lafayette, LA (US)

(72) Inventors: Randall C. LeBlanc, Lafayette, LA (US); Carl S. LeBlanc, Lafayette, LA (US); Jerry Ray Werlla, New Braunfels, TX (US)

(73) Assignee: Coiled Tubing Rental Tools, Inc., Lafayette, LA (US)

( * ) Notice: Subject to any disclaimer, the term of this patent is extended or adjusted under 35 U.S.C. 154(b) by 0 days.

(21) Appl. No.: 14/675,281

(22) Filed: Mar. 31, 2015

(51) Int. Cl.
*E21B 17/06* (2006.01)
*E21B 23/04* (2006.01)

(52) U.S. Cl.
CPC ..... *E21B 17/06* (2013.01); *E21B 23/04* (2013.01)

(58) Field of Classification Search
CPC ..... E21B 17/06; E21B 23/04; E21B 23/00
See application file for complete search history.

(56) References Cited

U.S. PATENT DOCUMENTS 4,452,472 A * 6/1984 Crase ..... 285/3
5,146,984 A * 9/1992 Pleasants ..... 166/238
5,419,399 A * 5/1995 Smith ..... 166/377
5,526,888 A * 6/1996 Gazewood ..... 175/320
6,131,953 A * 10/2000 Connell et al. ..... 285/3
6,408,946 B1 * 6/2002 Marshall et al. ..... 166/317
7,836,958 B2 11/2010 Gazewood
8,464,788 B2 6/2013 Stanford

OTHER PUBLICATIONS

Thru Tubing Solutions—Product Details, "Hydraulic Disconnect", 2 pages. Online Brochure retrieved from Internet on Feb. 11, 2015 at htip://www.thrutubing.com/ProductDetails.aspx?Productld=18.

* cited by examiner

*Primary Examiner* — Robert E Fuller
(74) *Attorney, Agent, or Firm* — Fish & Richardson P.C.

(57) ABSTRACT

A disconnect tool includes a bottom housing having a central longitudinal axis, a top housing, a release piston, and a shear sleeve. The bottom housing includes an internal torque transmission portion and an internal locking portion. The top housing includes a lower portion positioned within the bottom housing, where the outer surface includes an external locking portion to engage the internal locking portion of the bottom housing and an external torque transmission portion to engage the internal torque transmission portion of the bottom housing. The release piston translates longitudinally within the top housing along the central longitudinal axis from a locked position to an unlocked position. The shear sleeve secures the release piston in the locked position and disconnects from the release piston at a threshold force on the release piston to allow the release piston to translate along the central longitudinal axis to the unlocked position.

27 Claims, 8 Drawing Sheets

IN-WELL DISCONNECT TOOL

TECHNICAL FIELD

This disclosure relates to disconnect tools, for example, hydraulic disconnect tools for work strings in a wellbore.

BACKGROUND

During wellbore operations, such as drilling and producing a well, an operator controls a work string disposed within the wellbore to perform various tasks. Sometimes, a work string is to be withdrawn from the wellbore with a portion of the work string (e.g., downhole portion, bottom hole assembly, or other) to remain in the wellbore. Work strings may include joints of threaded and coupled tubing, drill pipe, or a continuous tube of a coiled tubing string. Disconnect tools allow for separation of the work string at a downhole location to disconnect the portion of the work string (e.g., downhole portion, bottom hole assembly) to remain in the wellbore with the remainder of the work string to be removed from the wellbore.

Disconnect tools are used to allow selective release of the portion of the work string positioned below the disconnect tool. A hydraulic disconnect tool can separate upon application of a hydraulic pressure greater than a release pressure threshold.

SUMMARY

This disclosure describes in-well disconnect tools.

In some aspects, a disconnect tool for use in a wellbore includes a tubular bottom housing having a central longitudinal axis, a tubular top housing having a central longitudinal axis aligned with the central longitudinal axis of the bottom housing, a tubular release piston, and a shear sleeve disposed within the tubular top housing and attached to the tubular release piston. The bottom housing includes at least an inner surface including an internal torque transmission portion and an internal locking portion. The top housing includes at least a lower portion including an outer surface positioned at least partially within the bottom housing, the outer surface including an external locking portion adapted to engage the internal locking portion of the bottom housing and an external torque transmission portion adapted to engage the internal torque transmission portion of the bottom housing. The tubular release piston includes an upper portion disposed within the tubular top housing, the upper portion including a first upper portion including at least a first outer diameter, a second upper portion proximate the first upper portion and including at least a second outer diameter less than the first outer diameter, and a valve seat, where the piston is adapted to translate longitudinally within the top housing along the central longitudinal axis from a locked position to an unlocked position. The shear sleeve is adapted to secure the tubular release piston in the locked position and to disconnect from the tubular release piston at a threshold force on the tubular release piston allowing the tubular release piston to translate along the central longitudinal axis to the unlocked position.

This, and other aspects, can include one or more of the following features. The disconnect tool can include a retaining ring engaged with the top housing to resist movement of the shear sleeve toward an upper end of the tubular top housing. The internal locking portion of the tubular bottom housing can include at least one circumferential keyway, and the external locking portion of the tubular top housing can include at least one circumferential key to engage with the at least one circumferential keyway of the internal locking portion of the tubular bottom housing. The tubular top housing can include longitudinal collet slots through the external locking portion of the tubular top housing. The longitudinal collet slots can include linear slots substantially parallel to the central longitudinal axis of the tubular top housing. The longitudinal collet slots can include nonlinear slots through the external locking portion of the tubular top housing. The internal torque transmission portion of the tubular bottom housing can include internal splines, and the external torque transmission portion of the tubular top housing can include external splines mating with the internal splines of the tubular bottom housing. The tubular top housing can include an inner shoulder, and the piston can include a piston shoulder adjacent the first upper portion and adapted to engage the inner shoulder of the tubular top housing when the piston is in the unlocked position. The bottom housing can include an inner shoulder to abut an edge surface of the top housing. The top housing can include an inner shoulder to abut an edge surface of the shear sleeve. The shear sleeve includes at least one shear pin attaching the tubular release piston to the shear sleeve, the shear pin adapted to secure the tubular release piston in the locked position. The bottom housing can include a pin end at a longitudinal end of the bottom housing to engage with a component of a downhole well assembly. The component of the downhole well assembly can include a well drilling tool. The top housing can include a box end at a longitudinal end of the top housing to engage with a component of a downhole well assembly. The component of the downhole well assembly can include a work string selected from the group consisting of threaded and coupled tubing, drill pipe, and coiled tubing. The tubular bottom housing can include a retrieval profile at the inner surface of the tubular bottom housing, the retrieval profile adapted to receive a fishing tool. The valve seat can be adapted to receive and seal against a valve member selected from the group consisting of a ball and a plug.

Some aspects of the subject matter described herein can include a method of disconnecting from a bottom hole assembly within a wellbore. The method includes providing a disconnect tool in a bottom hole assembly, where the disconnect tool includes a tubular bottom housing having a central longitudinal axis, a tubular top housing having a central longitudinal axis aligned with the central longitudinal axis of the bottom housing, a tubular release piston including an upper portion disposed within the tubular top housing, and a shear sleeve disposed within the tubular top housing and attached to the tubular release piston. The bottom housing includes an inner surface including an internal torque transmission portion and an internal locking portion. The tubular top housing includes a lower portion including an outer surface positioned at least partially within the bottom housing, the outer surface including an external locking portion adapted to engage the internal locking portion of the bottom housing and an external torque transmission portion adapted to engage the internal torque transmission portion of the bottom housing. The upper portion of the tubular release piston includes a first upper portion having a first outer diameter, a second upper portion proximate the first upper portion and having a second outer diameter less than the first outer diameter, and a valve seat, the piston adapted to translate longitudinally within the top housing along the central longitudinal axis from a locked position to an unlocked position. The shear sleeve is adapted to secure the tubular release piston in the locked position and to disconnect from the tubular release piston at a threshold force on the tubular release piston allowing the tubular release piston to translate along the central longitudinal axis to the unlocked position. The method includes engaging a pressure seal of the disconnect tool to translate the piston from the locked position to the unlocked position, and exerting a force on the tubular top housing along the central longitudinal axis of the tubular top housing and away from the tubular bottom housing resulting in disengaging the external locking portion of the top housing from the internal locking portion of the bottom housing.

This, and other aspects, can include one or more of the following features. Exerting a force on the tubular top housing can include disconnecting the tubular top housing from the tubular bottom housing and moving the tubular top housing along the central longitudinal axis away from the bottom housing. The method can include running a fishing tool into the wellbore, engaging the fishing tool with the tubular bottom housing, and retrieving the tubular bottom housing from the wellbore. Engaging the fishing tool with the tubular bottom housing can include latching the fishing tool into a retrieval profile of the tubular bottom housing. Exerting a force on the tubular top housing along the central longitudinal axis of the tubular top housing and away from the tubular bottom housing resulting in disengaging the external locking portion of the top housing from the internal locking portion of the bottom housing can include allowing the internal locking portion of the tubular top housing to move radially inward relative to the central longitudinal axis of the tubular top housing to disengage from the internal locking portion of the tubular bottom housing. Engaging a pressure seal of the disconnect tool can include engaging a valve member with the valve seat of the tubular release piston of the disconnect tool and applying a hydraulic pressure against the tubular release piston. Engaging a pressure seal of the disconnect tool can include shearing a shear pin attaching the tubular release piston to the shear sleeve to detach the tubular release piston from the shear sleeve. The method can include pumping a valve member through the wellbore to engage and seal the valve member with the valve seat, and increasing pressure against the valve member engaged with the valve seat to shear the shear pin attaching the tubular release piston to the shear sleeve and move the tubular release piston from the locked position to the unlocked position. Engaging a pressure seal of the disconnect tool to translate the piston from the locked position to the unlocked position can include allowing the tubular release piston to translate within the tubular top housing until a piston shoulder of the tubular release piston engages an inner shoulder of the tubular top housing.

In some aspects, a disconnect tool for use in a wellbore includes a tubular bottom housing having a central longitudinal axis, a tubular top housing having a central longitudinal axis aligned with the central longitudinal axis of the bottom housing, a tubular release piston including an upper portion disposed within the tubular top housing, and a shear sleeve disposed within the tubular top housing and attached to the tubular release piston. The bottom housing has an inner surface including an internal torque transmission portion and an internal locking portion. The tubular top housing includes a lower portion including an outer surface positioned at least partially within the bottom housing, the outer surface including an external locking portion adapted to engage the internal locking portion of the bottom housing and an external torque transmission portion adapted to engage the internal torque transmission portion of the bottom housing. The upper portion of the release piston includes a first upper portion having a first outer diameter, a second upper portion proximate the first upper portion and having a second outer diameter less than the first outer diameter, and a valve seat, the piston adapted to translate longitudinally within the top housing along the central longitudinal axis from a locked position to an unlocked position. The shear sleeve is adapted to secure the tubular release piston in the locked position and to disconnect from the tubular release piston at a threshold force on the tubular release piston allowing the tubular release piston to translate along the central longitudinal axis to the unlocked position.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
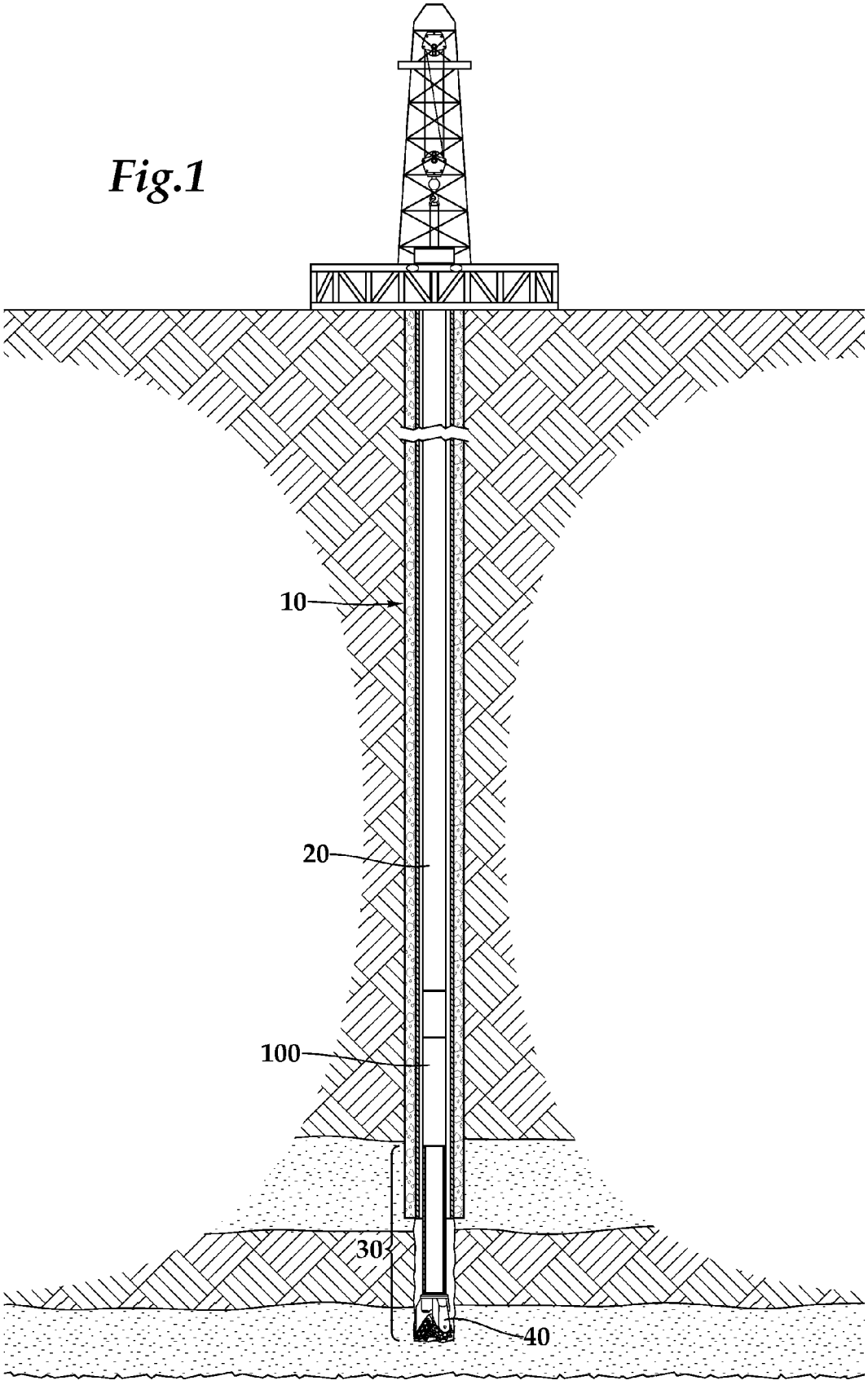
FIG. 1 is a schematic view of a wellbore with a work string and a disconnect tool disposed in the wellbore.

This disclosure describes disconnect tools for a work string (e.g., threaded and coupled tubing string, drill pipe string, continuous coiled tubing string), for example, in-well type hydraulic disconnect tools used in the oil and gas industry. In downhole operations of oil and gas wells, it is sometimes necessary and/or desirable to leave a bottom hole assembly or other portion of a work string in a well and remove the rest of the work string. FIG. 1 is a schematic view illustrating a wellbore 10 with a work string 20 disposed in the wellbore 10. The work string 20 includes a bottom hole assembly 30 including a drill bit 40 and an example disconnect tool 100 to allow separation of the work string 20 at the disconnect tool 100. For example, a well tool (e.g., drill bit 40) of the bottom hole assembly 30 can become jammed and/or lodged in the wellbore 10, and the disconnect tool 100 can disconnect the work string 20 at a point uphole of the jammed or lodged well tool. This allows an operator to retrieve the work string 20 uphole of the jammed or lodged well tool, and, if desired, subsequently remove the well tool from the wellbore 10. The disconnect tool 100 can be placed at any point on the work string 20, for example, just uphole of a well tool (e.g., drill bit 40) of the bottom hole assembly 30 in the wellbore 10.

Figure 2:
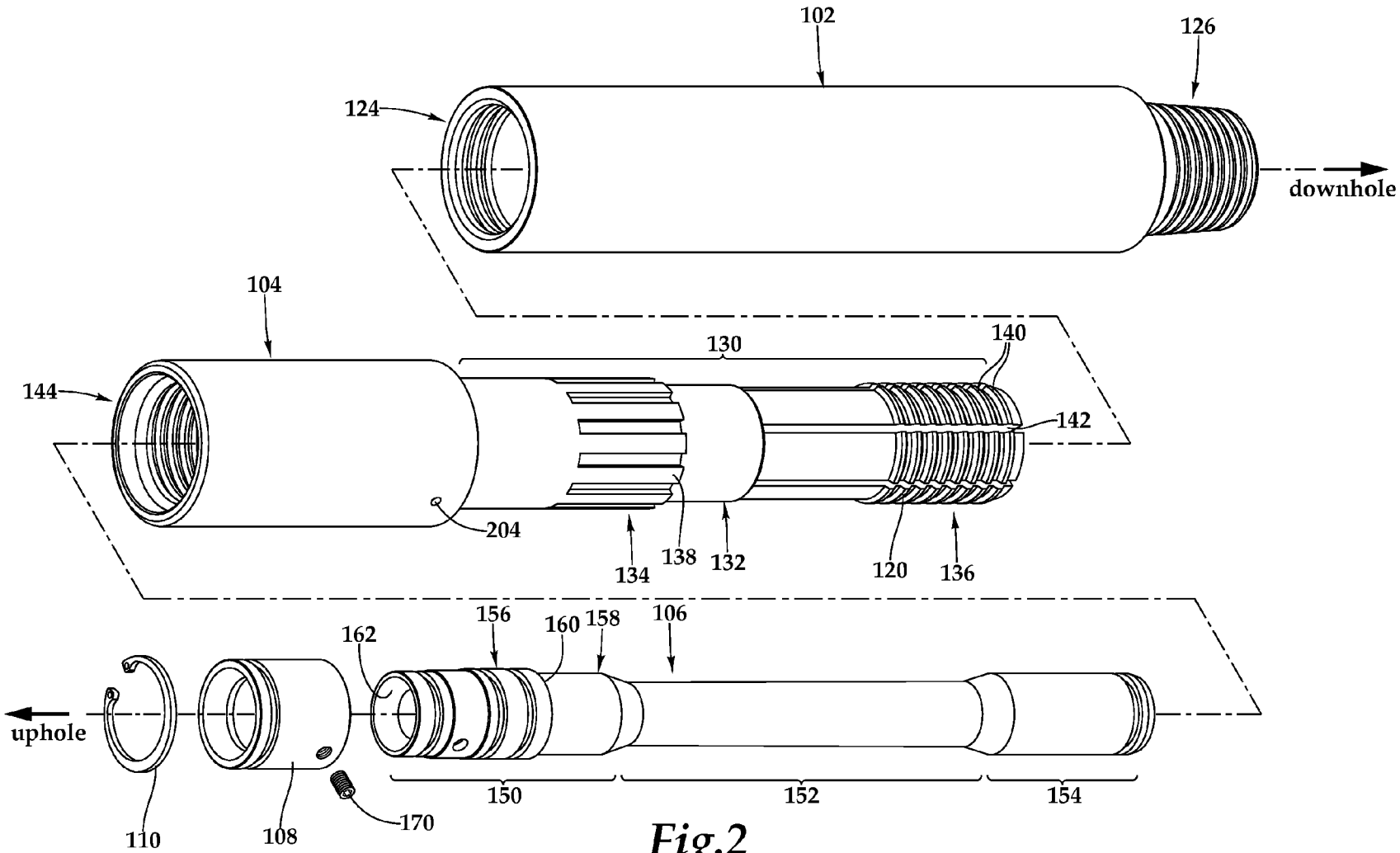
FIG. 2 is a perspective exploded view of an example disconnect tool.
Figure 3A:
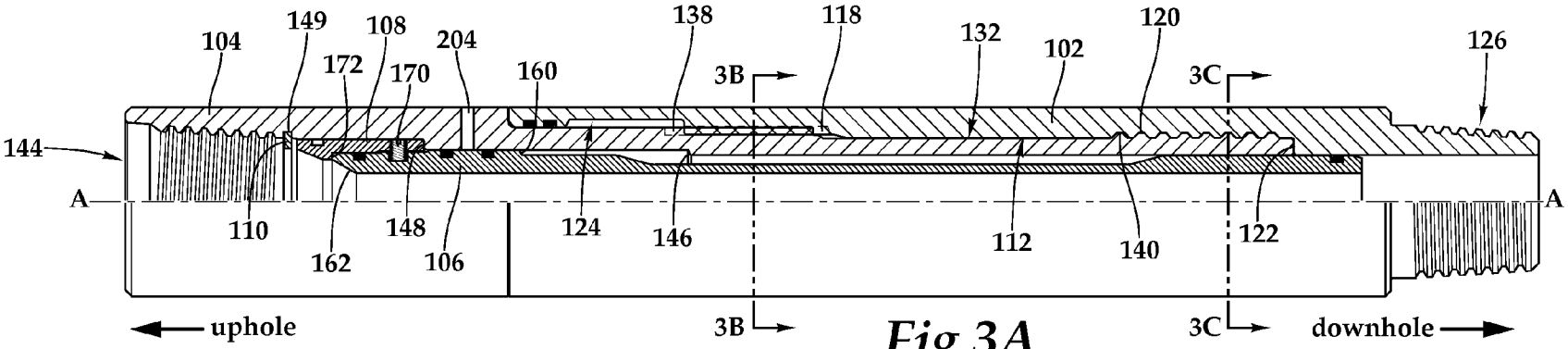
FIG. 3A is a partial cross-sectional side view of an example disconnect tool.
Figure 6A:
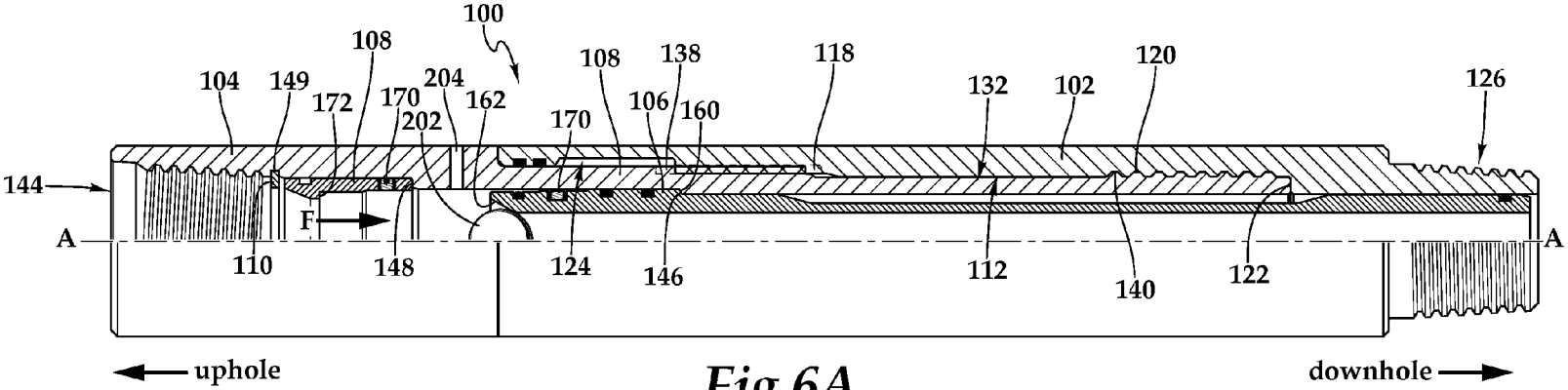
FIGS. 6A-6D are partial cross-sectional side views of an example disconnect tool transitioning from a locked position to an unlocked position.
Figure 6B:
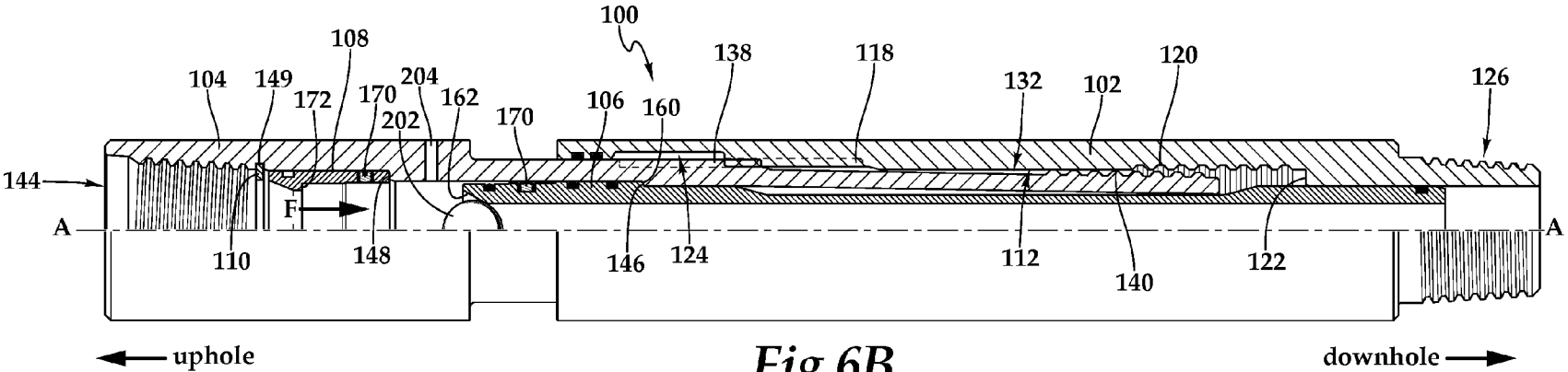

FIG. 2 is an exploded perspective view of the example disconnect tool 100 of FIG. 1, and FIG. 3A is a partial cross-sectional side view of the example disconnect tool 100. FIG. 2 shows the example disconnect tool 100 before assembly, whereas FIG. 3A shows the example disconnect tool 100 after assembly and in a locked position, ready to be inserted into a wellbore (e.g., wellbore 10 of FIG. 1). The example disconnect tool 100 is assembled before insertion into the wellbore 10. Referring to both FIGS. 2 and 3A, the example disconnect tool 100 includes a bottom housing 102, a top housing 104, a release piston 106, a shear sleeve 108, and a retaining ring 110. The components of the example disconnect tool 100 are oriented about a central longitudinal axis A-A. The top housing 104 is partially disposed concentrically within the bottom housing 102, the release piston 106 is partially disposed concentrically within the top housing 104, and the shear sleeve 108 is disposed within the top housing 104 and surrounds a portion of the release piston 106. The release piston 106 can translate longitudinally within the top housing along the central longitudinal axis from the locked position shown in FIG. 3A to an unlocked position (e.g., as shown in FIG. 6A). The bottom housing 102 and the top housing 104 selectively lock to each other based on a location of the release piston 106 disposed within the top housing 104. The shear sleeve 108 selectively attaches to and positions the release piston 106 in the locked position to secure the top housing 104 to the bottom housing 102. The retaining ring 110 retains the shear sleeve 108 within the top housing 104, for example, by restricting movement of the shear sleeve 108.

Figure 4A:
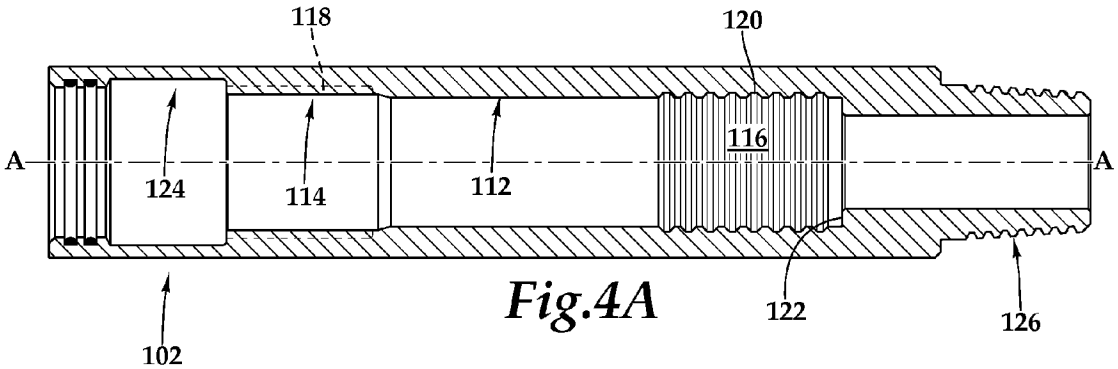
FIGS. 4A-4D are cross-sectional side views of an example bottom housing, top housing, release piston, and shear sleeve, respectively, of an example disconnect tool.

FIG. 4A is a cross-sectional side view of the example bottom housing 102 of the example disconnect tool 100 of FIGS. 2 and 3A. The bottom housing 102 is substantially tubular, and includes an inner surface 112 with an internal torque transmission portion 114 and an internal locking portion 116. In the example bottom housing 102 of FIG. 4A, the internal torque transmission portion 114 includes internal splines 118 substantially parallel to the central longitudinal axis A-A, and the internal locking portion 116 includes multiple circumferential keyways 120. The circumferential keyways 120 are shown as semicircular concave recesses in the inner surface 112 of the bottom housing 102, but can take a variety of shapes (e.g., rectangular, barbed, triangular, and/or other). Although the internal locking portion 116 of FIG. 4A includes eight keyways 120, the bottom housing 102 can include a different number of keyways 120 (e.g., one, two, three, or more). The bottom housing 102 includes an inner shoulder 122, for example, to abut a longitudinal end surface (e.g., bottom edge) of the top housing 104 and longitudinally position the top housing 104 disposed in part within the bottom housing 102.

The example bottom housing 102 also includes a retrieval profile 124 in the inner surface 112 of the bottom housing 102. The retrieval profile 124 is shown as a recess in the inner surface 112 near an upper longitudinal end of the bottom housing 102. The example bottom housing 102 also includes a bottom pin end 126 at a longitudinal end (i.e., bottom end) of the bottom housing 102, for example, to engage with a component of a downhole well assembly (e.g., bottomhole assembly including a drill bit, well production tool, and/or other downhole tools). FIG. 4A shows the bottom pin end 126 as a threaded male coupling, but the bottom pin end 126 can be different (e.g., female coupling, threaded coupling, and/or other).

Figure 3B:
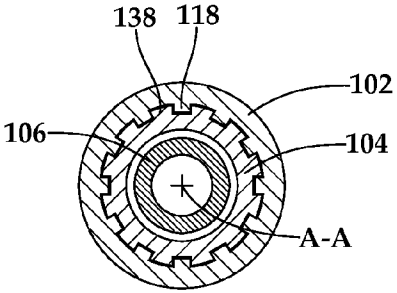
FIGS. 3B and 3C are cross-sectional views along sections taken through the example disconnect tool of FIG. 3A.
Figure 4B:
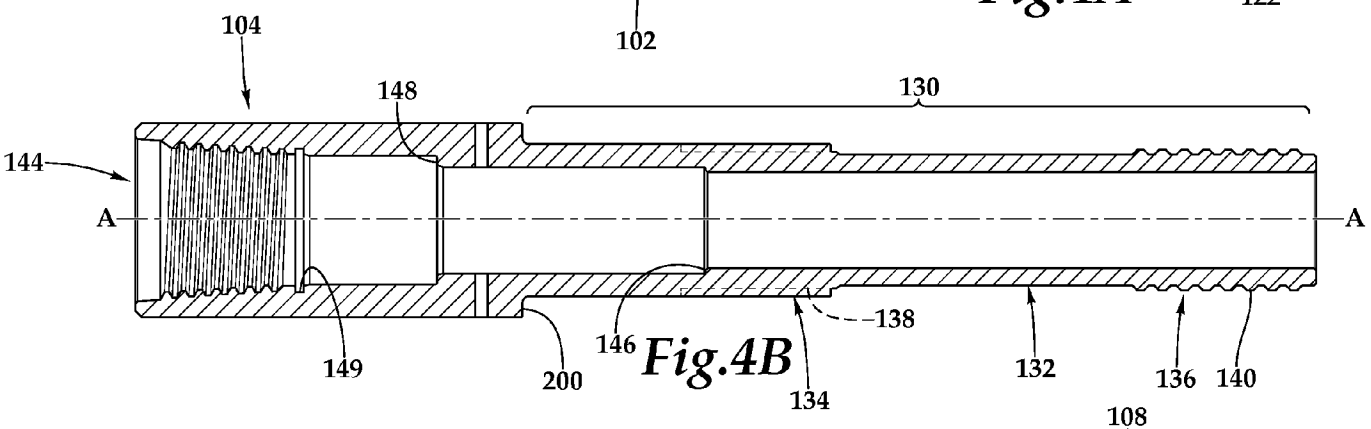

FIG. 4B is a cross-sectional side view of the example top housing 104 of the example disconnect tool 100 of FIGS. 2 and 3A. The top housing 104 selectively connects to and locks (i.e., longitudinally lock and rotationally lock) with the bottom housing 102. The top housing 104 is substantially tubular, and includes a lower portion 130 with an outer surface 132 positioned within the bottom housing 102 when assembled. The outer surface 132 includes an external torque transmission portion 134 to engage the internal torque transmission portion 114 of the bottom housing 102, for example, to align the top housing and the bottom housing. Engaging the torque transmission portions of the bottom housing 102 and top housing 104 allows for the transfer of rotational movement and/or torque between the top housing 104 and bottom housing 102. For example, a rotationally driven top housing 104 can transfer its rotation and torque to the bottom housing 102 when the external torque transmission portion 134 is engaged with the internal torque transmission portion 114. In the example top housing 104 of FIG. 4B, the external torque transmission portion 134 includes external splines 138 substantially parallel to the central longitudinal axis A-A to engage with the internal splines 118 of the bottom housing 102. FIG. 3B is a cross-sectional view taken through section 3B-3B of FIG. 3A, showing the internal splines 118 of the bottom housing 102 engaged with the external splines 138 of the top housing 104.

The internal and external torque transmission portions 134 and 114 can include additional or different features. For example, the torque transmission portions 134 and 114 can include a different profile, shape, and/or spline type that allows for torque transfer between the top housing 104 and the bottom housing. For example, the torque transmission portions 134 and 114 can include matching polygonal shape profiles (e.g., triangle, rectangle, hexagon, and/or other), differently shaped splines (e.g., triangular, curved, and/or other), and/or other features to transfer rotation between the top housing 104 and the bottom housing 102. The profiles can be substantially matching between the internal torque transmission portion 114 and the external torque transmission portion 134; however, the profiles do not need to be exact replicas of each other. For example, the profiles can include differences, so long as they match substantially enough to mesh and allow torque transfer between the top housing 104 and bottom housing 102.

The outer surface 132 of the lower portion 130 of the top housing 104 also includes an external locking portion 136 to engage with the internal locking portion 116 of the bottom housing 102. Engaging the locking portions of the bottom housing 102 and top housing 104 allows for the transfer of longitudinal movement or translation (i.e., along the central longitudinal axis A-A) between the top housing 104 and bottom housing 102. The external locking portion 136 of the top housing includes an integral male profile in the outer surface 132 of the top housing 104, and the internal locking portion 116 of the bottom housing 102 includes an integral female profile in the inner surface 112 of the bottom housing 102 that substantially mates with the male profile of the exterior locking portion 136. In the example top housing 104 of FIG. 4B, the external locking portion 136 includes multiple circumferential keys 140. The circumferential keys 140 are shown as semicircular convex recesses in the inner surface 112 of the bottom housing 102, but can take a variety of shapes (e.g., rectangular, barbed, triangular, and/or other). The circumferential keys 140 (substantially or exactly) match the circumferential keyways 120 of the bottom housing 102. Although the external locking portion 136 of FIG. 4B includes eight keys 140, the top housing 104 can include a different number of keys 140 (e.g., one, two, three, or more). In some instances, the external locking portion 136 of the top housing 104 includes an integral female profile (e.g., circumferential keyways), and the internal locking portion 116 of the bottom housing 102 includes an integral male profile (e.g., circumferential keys). In other words, the profiles of the external locking portion 136 and the internal locking portion 116 can be different (e.g., switched).

Figure 3C:
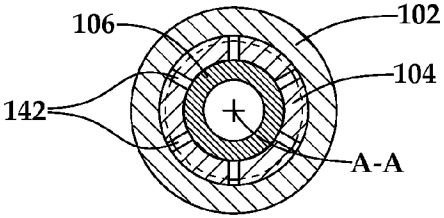

The top housing 104 also includes longitudinal collet slots 142 through the external locking portion 136 of the top housing 104 to allow radial movement, or adjustment, of the external locking portion 136 relative to the central longitudinal axis A-A. Referring to the example top housing 104 of FIGS. 2, 3A, and 4B, the longitudinal collet slots 142 include linear slots substantially parallel to the central longitudinal axis A-A. In some instances, the longitudinal collet slots 142 include nonlinear slots through the external locking portion 136. FIG. 3C is a cross-sectional view through section 3C-3C of FIG. 3A, showing the collet slots 142 through the external locking portion 136 of the top housing 104, defining the external locking portion 136 as including finger-like members. The top housing 104 also includes a top box end 144 at a longitudinal end (i.e., top end) of the top housing 104, for example, to engage with a component of a downhole well assembly (e.g., threaded tubing, coiled tubing, other tubing, or other component). The top box end 144 is shown as a threaded female coupling, but the top box end 144 can be different (e.g., male coupling, threaded coupling, and/or other).

Figure 4E:
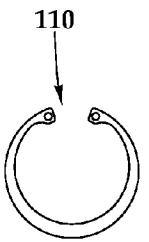
FIG. 4E is a top view of an example retaining ring of the example disconnect tool.
Figure 4D:
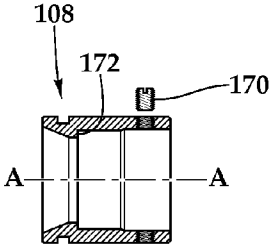
Figure 4C:
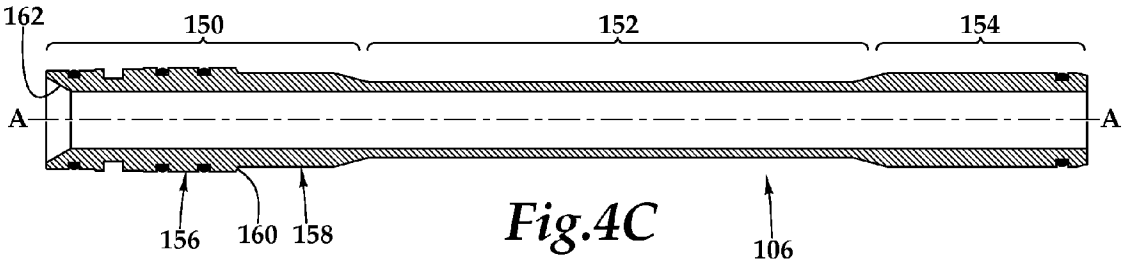

FIG. 4C is a cross-sectional side view of the example release piston 106 of the example disconnect tool 100 of FIGS. 2 and 3A. The release piston 106 is substantially tubular, and is disposed within the top housing 104. The release piston includes an upper portion 150, an intermediate portion 152, and a lower portion 154. The upper portion 150 includes a first upper portion 156 with a first outer diameter, and a second upper portion 158 with a second outer diameter less than the first outer diameter. A shoulder 160 between the first upper portion 156 and the second upper portion 158 is adapted to engage a corresponding inner shoulder 146 of the top housing 104 in the unlocked position of the disconnect tool 100 (e.g., see FIG. 6A) when the release piston 106 is translated longitudinally in a downhole direction. An outer diameter of the intermediate portion 152 is less than an outer diameter of the lower portion 154. The outer diameter of the lower portion 154 substantially matches the inner diameter of the top housing 104 at the external locking portion 136. With the release piston 106 in the locking position as shown in FIG. 3A, the lower portion 154 of the release piston 106 is positioned adjacent the external locking portion 136 of the top housing to radially secure the external locking portion 136 of the top housing into engagement with the internal locking portion 116 of the bottom housing 102. An outer surface of the lower portion 154 is radially flush (at least in part) against the inner surface of the top housing 104 at the external locking portion 136 and ensures the external locking portion 136 stays engaged with the internal locking portion 116 of the bottom housing 102.

The release piston 106 also includes a valve seat 162 at a first longitudinal end (i.e., top end) of the release piston 106. The valve seat 162 is adapted to receive and seal against a valve member, such as a ball, plug, or other component. The valve seat 162 can be an uphole facing seat to receive a valve member pumped down the work string from an uphole location.

FIG. 4D is a cross-sectional side view of the example shear sleeve 108 of the example disconnect tool 100 of FIGS. 1 and 3A. The shear sleeve 108 selectively attaches to the release piston 106 with a temporary lock. In the example shear sleeve 108, the temporary lock includes shear pins 170 to attach the release piston 106 to the shear sleeve 108. When assembled, the shear pins 170 secure the release piston 106 in the locked position. The shear sleeve 108 is disposed within the top housing 104 and abuts a sleeve seat 148 of the top housing 104. The shear sleeve 108 secures the release piston 106 in the locked position until the temporary lock is broken. For example, the release piston 106 can disconnect from the shear sleeve 108 at a threshold force (e.g., pressure threshold) acting longitudinally on the release piston 106 and to translate along the central longitudinal axis A-A in a downhole direction to the unlocked position. Although the shear pins 170 secure release piston 106 in the locked position, the shear sleeve 108 can also include an inner shoulder 172 to abut a top longitudinal end of the release piston 106, for example, to keep the release piston 106 from translating uphole of the shear sleeve 108. FIG. 4E is a top view of the retaining ring 110 of the example disconnect tool 100. When assembled, the retaining ring 110 engages with a recess 149 of the top housing 104 to resist movement of the shear sleeve 108 toward the top box end 144 of the top housing 104. The example retaining ring 110 is shown as having a partial circular shape with an inner diameter less than an outer diameter of the shear sleeve 108. However, the retaining ring 110 can include additional or different features. For example, the retaining ring can include protrusions of the top housing 104 extending radially inward toward the central longitudinal axis A-A to resist uphole movement of the shear sleeve 108.

The example disconnect tool 100 and the components of the example disconnect tool 100 can include additional and/or different features. In some instances, the example disconnect tool 100 includes a plurality of sealing structures between the components of the disconnect tool 100, for example, to fluidly seal the components to each other. For example, FIG. 3A shows O-rings between top housing 104 and the bottom housing 102, between the release piston 106 and the top housing 104, and between the release piston 106 and the shear sleeve 108. The example disconnect tool 100 can include different kinds and/or a different number of sealing structures. In some instances, the external locking portion 136 can exclude the collet slots 142 and can include a default profile with an outer diameter less than the inner diameter of the bottom housing. The default profile of the external locking portion 136 can be extended outward through engagement with the lower portion 154 of the release piston 106. For example, the external locking portion 136 of the top housing 104 can include a rotatable key that can pivot on a rotating axis from an unlocked, retracted position to a locked, extended position. The lower portion 154 of the release piston 106 can force the rotatable key to rotate radially outward to the locked, extended position and engage the internal locking portion 116 of the bottom housing. In some instances, the rotatable key includes a torsion spring about its rotating axis to bias the rotatable key to the unlocked position such that only engagement of the lower portion 154 of the release piston 106 moves the rotatable key into engagement with the internal locking portion 116 of the bottom housing 102.

Disconnect tools, such as example disconnect tool 100, can be used in a variety of applications, such as drilling and production operations in a wellbore of a well. The use of the terms up, down, top, bottom, upper, lower, above, below, uphole, downhole, and other directional language represent illustrative positions, orientations, and/or movements within the disconnect tool 100 and/or within a wellbore, and are not intended to be limited to vertical directions. For example, disconnect tools such as example disconnect tool 100 can be used in vertical wells, horizontal wells, multilateral wells, deviated wells, and/or other types of wells.

Figure 5A:
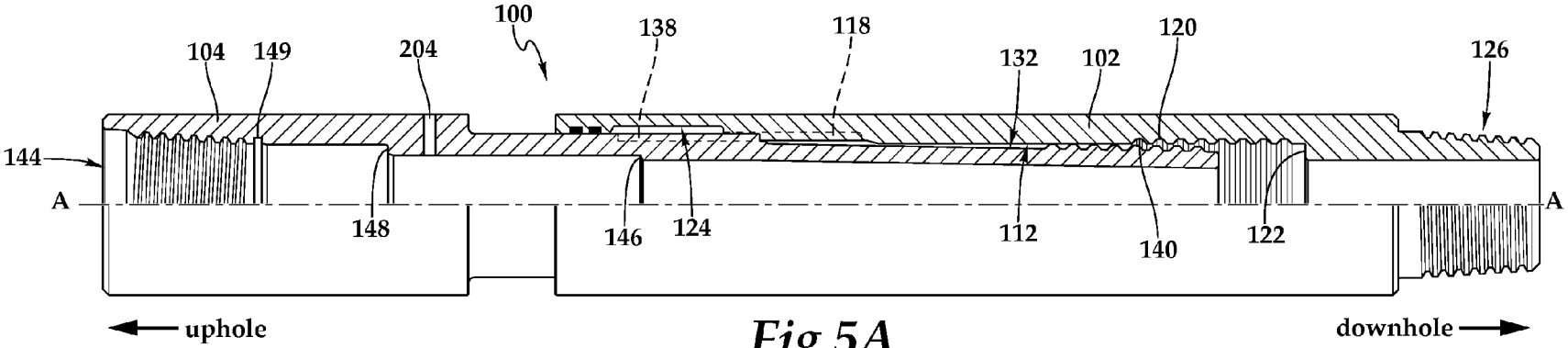
FIGS. 5A-5D are partial cross-sectional side views of an example disconnect tool as the example disconnect tool is being assembled into a locked position.
Figure 5B:
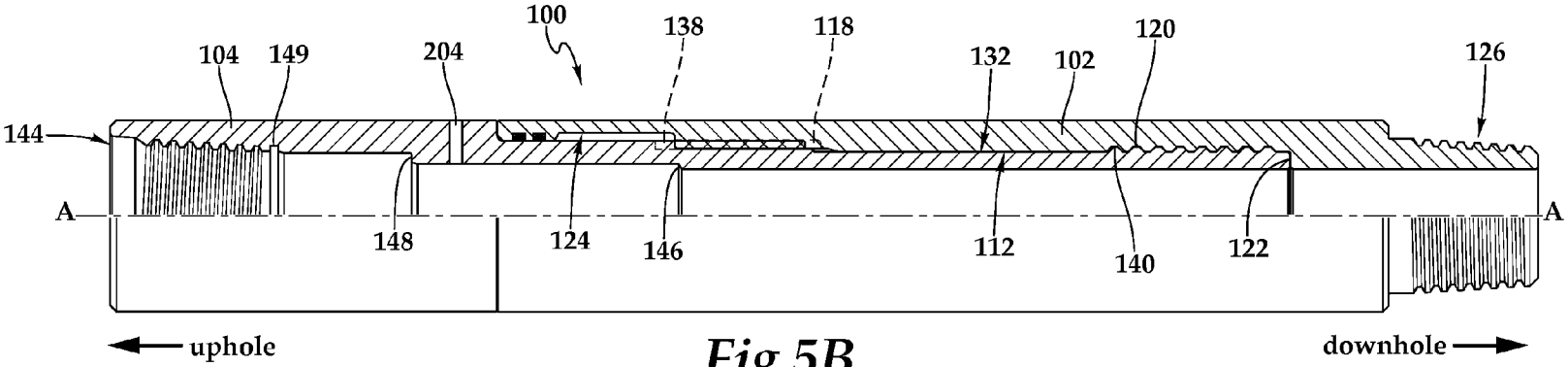
Figure 5C:
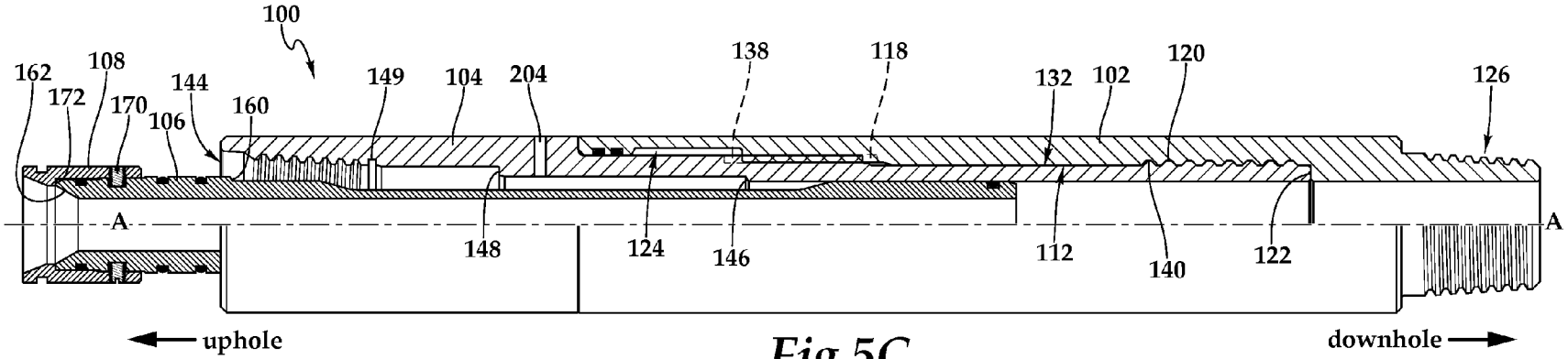
Figure 5D:
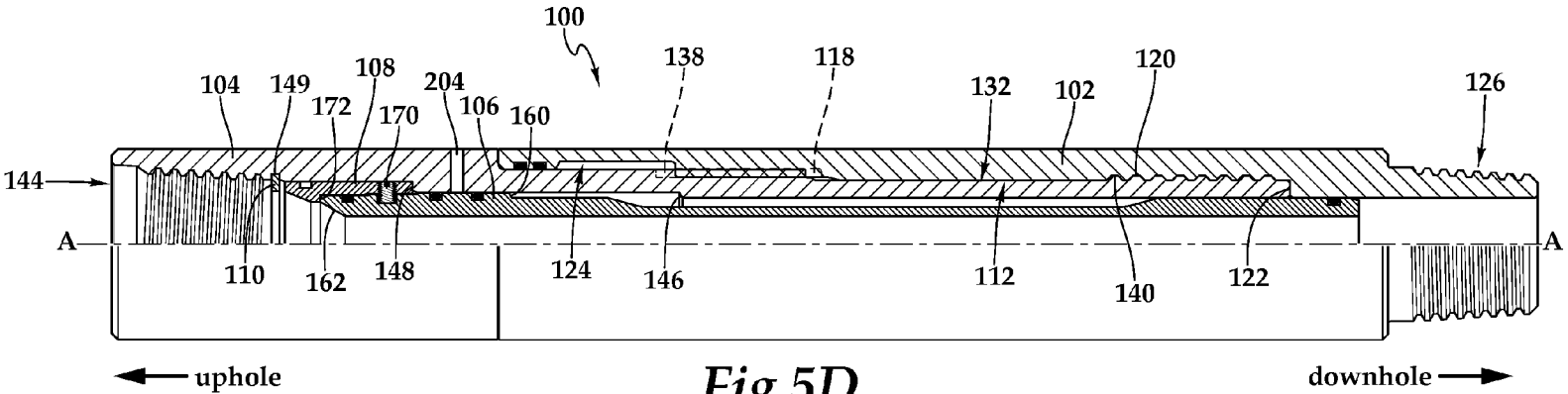

FIGS. 5A-5D are partial cross-sectional side views of the example disconnect tool 100 showing an assembly of the disconnect tool 100 into the locked position. In FIG. 5A, the lower portion 130 of the top housing 104 is inserted into the bottom housing 102 such that the external splines 138 of the top housing 104 begin to mesh with the internal splines 118 of the bottom housing 102. The longitudinal collet slots 142 of the top housing 104 allow the external locking portion 136 of the top housing 104 to move radially inward (relative to the central longitudinal axis A-A) to allow the external locking portion 136 of the top housing 104 to pass along the inner surface 112 of the bottom housing 102 before reaching the internal locking portion 116 of the bottom housing. In FIG. 5B, the lower portion 130 of the top housing 104 is (completely or substantially) disposed within the bottom housing 102 so that the external locking portion 136 engages the internal locking portion 116, the external torque transmission portion 134 engages the internal torque transmission portion 114, a bottom edge of the top housing 104 abuts the inner shoulder 122 of the bottom housing 102, and an outer shoulder 200 of the top housing 104 abuts a longitudinal top surface of the bottom housing 102. In FIG. 5C, the release piston 106 is inserted into the top housing 104. The shear sleeve 108 is attached to the release piston 106 using the shear pins 170. The outer surface of the lower portion 154 of the release piston 106 is flush with the inner surface of the top housing 104. In FIG. 5D, the release piston 106 and shear sleeve 108 are disposed within the top housing 104 so that the lower portion 154 of the release piston 106 is flush with the inner surface of the top housing 104 proximal to the external locking portion 136 of the top housing 104, putting the example disconnect tool 100 in the locked position. The locked position corresponds to the lower portion 154 of the release piston 106 abutting the inner surface of the top housing 104 adjacent the external locking portion 136 to resist radial movement of the external locking portion 136 of the top housing 104 relative to the central longitudinal axis A-A. A longitudinal bottom end of the shear sleeve 108 abuts the sleeve seat 148 of the top housing 104 to position the release piston 106 in the locked position. The retaining ring 110 is disposed partially within the recess 149 of the top housing 104 to resist movement of the shear sleeve 108 toward the top box end 144 of the top housing 104. In some instances, the retaining ring 110 isolates the shear sleeve 108 to one area relative to the top housing 104 to reduce potential fatigue stress of the shear pins 170 due to vibration, axial impact, eccentric rotation motion, and/or other movement. In the locked position of the example disconnect tool 100 of FIG. 5D, fluid can be communicated through a central bore of the disconnect tool 100 along the central longitudinal axis, and rotation, force, and/or movement can be transferred between the top housing 104 and the bottom housing 102.

Figure 6C:
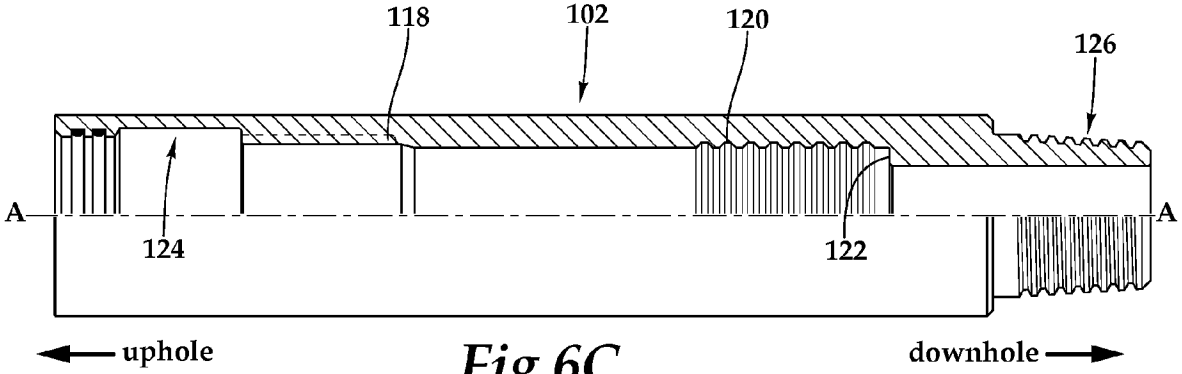

FIGS. 6A-6D are partial cross-sectional side views of the example disconnect tool 100 as the example disconnect tool 100 transitions in a downhole direction from the locked position to the unlocked position, then disconnected. In FIG. 6A, a pressure seal in the disconnect tool 100 is engaged. For example, a valve member 202 in the form of a drop ball engages the valve seat 162 (e.g., ball seat) of the release piston 106, for example, to seal (e.g., plug) the fluid pathway F through the disconnect tool 100 at the valve seat 162. The valve member 202 can be made of a suitable material to plug the valve seat 162, such as steel, another metal, rubber, and/or other. In some instances, the valve member 202 is pumped downhole through a work string, to which the disconnect tool 100 is integrally connected, and seals against the valve seat 162. A fluid pressure in the work string uphole of the valve member 202 increases to exert a force (e.g., hydraulic force) on the valve member 202. The hydraulic force exerted on the valve member 202 shears the shear pins 170, allowing the release piston 106 to disconnect from the shear sleeve 108 and translate in a downhole direction along the central longitudinal axis A-A. The shoulder 160 between the first upper portion 156 and the second upper portion 158 of the release piston 106 engages the corresponding inner shoulder 146 of the top housing 104 to stop the release piston 106 from translating further downhole relative to the top housing 104. A pressure relief 204 in the top housing 104 allows for fluid pressure acting against the valve member 202 to bypass to the wellbore exterior to the disconnect tool 100 after the release piston 106 translates from the locked position to the unlocked position. In the locked position, the release piston 106 seals the pressure relief 204 from fluid communicated through the disconnect tool 100. In the unlocked position, the release piston 106 is positioned further downhole relative to the top housing 104 to expose the pressure relief 204 to the fluid pathway F within the disconnect tool 100. The unlocked position corresponds to the release piston 106 positioned relative to the top housing 104 such that the intermediate portion 152 of the release piston 106 is positioned radially adjacent to the inner surface of the external locking portion 136 of the top housing 104 to allow radial movement of the external locking portion 136 relative to the central longitudinal axis A-A. For example, in FIG. 6B, a force is exerted on the top housing 104 in an uphole direction along the central longitudinal axis A-A to begin separation of the top housing 104 from the bottom housing 102. The longitudinal collet slots 142 allow the external locking portion 136 to disengage the internal locking portion 116 of the bottom housing by moving radially inward. Since the outer diameter of the intermediate portion 152 of the release piston 106 is less than the outer diameter of the lower portion 154 of the release piston 106, the release piston 106 does not prevent radially inward movement of the external locking portion 136 of the top housing 104. As the uphole force is applied to the top housing 104 to separate the top housing 104 and the bottom housing 102, the corresponding inner shoulder 146 allows the release piston 106 to move with the top housing 104, and the sleeve seat 148 allows the shear sleeve 108 to move with the top housing 104. For example, FIG. 6C shows the example disconnect tool 100 disconnected, such that the top housing 104, release piston 106, shear sleeve 108, and retaining ring 110 are completely separated from the bottom housing 102. Conventional disconnect tools do not allow for all components other than a bottom housing to be removed from a wellbore during an initial separation and retrieval step. For example, conventional disconnect tools do not have the ability to remove a drop ball and internal components in the separation and retrieval of conventional disconnect tools. However, the example disconnect tool 100 allows for retrieval of the internal components (e.g., top housing 104, release piston 106, and shear sleeve 108) and the valve member 202 (e.g., drop ball) after separation of the disconnect tool 100 in the wellbore.

Figure 6D:
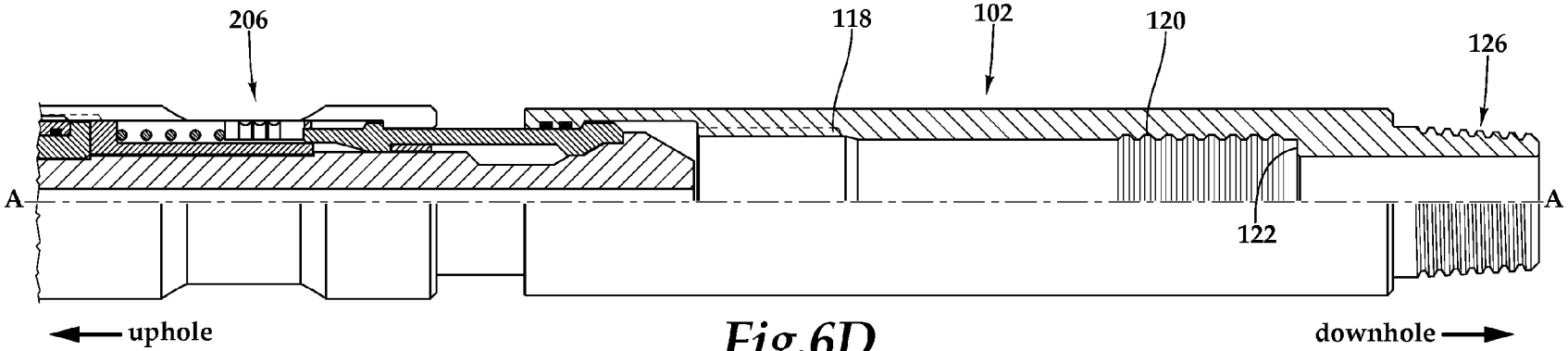

In some instances, such as depicted in FIG. 6D, a fishing tool 206, run into the wellbore on a wireline, slickline, or work string, can connect to and grasp the bottom housing 102 to remove the bottom housing and corresponding downhole assembly connected to the bottom housing 102 from the wellbore. The fishing tool 206 can have a corresponding profile that matches the retrieval profile 124 of the bottom housing.

A number of implementations have been described. Nevertheless, it will be understood that various modifications may be made without departing from the spirit and scope of the disclosure.

What is claimed is:

1. A disconnect tool for use in a wellbore, said disconnect tool comprising:

a tubular bottom housing having a central longitudinal axis, said bottom housing including at least an inner surface comprising an internal torque transmission portion and an internal locking portion;

a tubular top housing having a central longitudinal axis aligned with the central longitudinal axis of the bottom housing, said tubular top housing including at least a lower portion including an outer surface positioned at least partially within the bottom housing, said outer surface comprising an external locking portion adapted to engage the internal locking portion of the bottom housing and an external torque transmission portion adapted to engage the internal torque transmission portion of the bottom housing;

a tubular release piston comprising an upper portion disposed within the tubular top housing, said upper portion comprising a first upper portion including at least a first outer diameter, a second upper portion proximate the first upper portion and including at least a second outer diameter less than the first outer diameter, and a valve seat, the piston adapted to translate longitudinally within the top housing along the central longitudinal axis from a locked position to an unlocked position; and a shear sleeve disposed within the tubular top housing and attached to the tubular release piston, said shear sleeve adapted to secure the tubular release piston in the locked position and to disconnect from the tubular release piston at a threshold force on the tubular release piston allowing the tubular release piston to translate along the central longitudinal axis to the unlocked position.

2. The disconnect tool of claim 1, comprising a retaining ring engaged with the top housing to resist movement of the shear sleeve toward an upper end of the tubular top housing.

3. The disconnect tool of claim 1, wherein the internal locking portion of the tubular bottom housing comprises at least one circumferential keyway; and wherein the external locking portion of the tubular top housing comprises at least one circumferential key to engage with the at least one circumferential keyway of the internal locking portion of the tubular bottom housing.

4. The disconnect tool of claim 3, wherein the tubular top housing comprises longitudinal collet slots through the external locking portion of the tubular top housing.

5. The disconnect tool of claim 4, wherein the longitudinal collet slots comprise linear slots substantially parallel to the central longitudinal axis of the tubular top housing.

6. The disconnect tool of claim 4, wherein the longitudinal collet slots comprise nonlinear slots through the external locking portion of the tubular top housing.

7. The disconnect tool of claim 1, wherein the internal torque transmission portion of the tubular bottom housing comprises internal splines; and wherein the external torque transmission portion of the tubular top housing comprises external splines mating with the internal splines of the tubular bottom housing.

8. The disconnect tool of claim 1, wherein the tubular top housing further comprises an inner shoulder; and wherein the piston further comprises a piston shoulder adjacent the first upper portion and adapted to engage the inner shoulder of the tubular top housing when the piston is in the unlocked position.

9. The disconnect tool of claim 1, wherein the bottom housing comprises an inner shoulder to abut an edge surface of the top housing.

10. The disconnect tool of claim 1, wherein the top housing comprises an inner shoulder to abut an edge surface of the shear sleeve.

11. The disconnect tool of claim 1, wherein the shear sleeve includes at least one shear pin attaching the tubular release piston to the shear sleeve, said shear pin adapted to secure the tubular release piston in the locked position.

12. The disconnect tool of claim 1, wherein the bottom housing comprises a pin end at a longitudinal end of the bottom housing to engage with a component of a downhole well assembly.

13. The disconnect tool of claim 12, wherein the component of the downhole well assembly comprises a well drilling tool.

14. The disconnect tool of claim 1, wherein the top housing comprises a box end at a longitudinal end of the top housing to engage with a component of a downhole well assembly.

15. The disconnect tool of claim 14, wherein the component of the downhole well assembly comprises a work string selected from the group consisting of threaded and coupled tubing, drill pipe, and coiled tubing.

16. The disconnect tool of claim 1, wherein the tubular bottom housing further comprises a retrieval profile at the inner surface of the tubular bottom housing, the retrieval profile adapted to receive a fishing tool.

17. The disconnect tool of claim 1, the valve seat adapted to receive and seal against a valve member selected from the group consisting of a ball and a plug.

18. A method of disconnecting from a bottom hole assembly within a wellbore, the method comprising:

providing a disconnect tool in a bottom hole assembly, the disconnect tool comprising:

a tubular bottom housing having a central longitudinal axis, said bottom housing having an inner surface comprising an internal torque transmission portion and an internal locking portion;

a tubular top housing having a central longitudinal axis aligned with the central longitudinal axis of the bottom housing, said tubular top housing comprising a lower portion including an outer surface positioned at least partially within the bottom housing, said outer surface comprising an external locking portion adapted to engage the internal locking portion of the bottom housing and an external torque transmission portion adapted to engage the internal torque transmission portion of the bottom housing;

a tubular release piston comprising an upper portion disposed within the tubular top housing, said upper portion comprising a first upper portion having a first outer diameter, a second upper portion proximate the first upper portion and having a second outer diameter less than the first outer diameter, and a valve seat, the piston adapted to translate longitudinally within the top housing along the central longitudinal axis from a locked position to an unlocked position; and a shear sleeve disposed within the tubular top housing and attached to the tubular release piston, said shear sleeve adapted to secure the tubular release piston in the locked position and to disconnect from the tubular release piston at a threshold force on the tubular release piston allowing the tubular release piston to translate along the central longitudinal axis to the unlocked position; and engaging a pressure seal of the disconnect tool to translate the piston from the locked position to the unlocked position; and exerting a force on the tubular top housing along the central longitudinal axis of the tubular top housing and away from the tubular bottom housing resulting in disengaging the external locking portion of the top housing from the internal locking portion of the bottom housing.

19. The method of claim 18, wherein exerting a force on the tubular top housing comprises disconnecting the tubular top housing from the tubular bottom housing and moving the tubular top housing along the central longitudinal axis away from the bottom housing.

20. The method of claim 19, further comprising running a fishing tool into the wellbore, engaging the fishing tool with the tubular bottom housing, and retrieving the tubular bottom housing from the wellbore.

21. The method of claim 20, wherein engaging the fishing tool with the tubular bottom housing comprises latching the fishing tool into a retrieval profile of the tubular bottom housing.

22. The method of claim 18, wherein exerting a force on the tubular top housing along the central longitudinal axis of the tubular top housing and away from the tubular bottom housing resulting in disengaging the external locking portion of the top housing from the internal locking portion of the bottom housing comprises allowing the internal locking portion of the tubular top housing to move radially inward relative to the central longitudinal axis of the tubular top housing to disengage from the internal locking portion of the tubular bottom housing.

23. The method of claim 18, wherein engaging a pressure seal of the disconnect tool comprises engaging a valve member with the valve seat of the tubular release piston of the disconnect tool and applying a hydraulic pressure against the tubular release piston.

24. The method of claim 18, wherein engaging a pressure seal of the disconnect tool comprises shearing a shear pin attaching the tubular release piston to the shear sleeve to detach the tubular release piston from the shear sleeve.

25. The method of claim 24, comprising:

pumping a valve member through the wellbore to engage and seal the valve member with the valve seat; and increasing pressure against the valve member engaged with the valve seat to shear the shear pin attaching the tubular release piston to the shear sleeve and move the tubular release piston from the locked position to the unlocked position.

26. The method of claim 18, wherein engaging a pressure seal of the disconnect tool to translate the piston from the locked position to the unlocked position comprises allowing the tubular release piston to translate within the tubular top housing until a piston shoulder of the tubular release piston engages an inner shoulder of the tubular top housing.

27. A disconnect tool for use in a wellbore, said tool comprising:

a tubular bottom housing having a central longitudinal axis, said bottom housing having an inner surface comprising an internal torque transmission portion and an internal locking portion;

a tubular top housing having a central longitudinal axis aligned with the central longitudinal axis of the bottom housing, said tubular top housing comprising a lower portion including an outer surface positioned at least partially within the bottom housing, said outer surface comprising an external locking portion adapted to engage the internal locking portion of the bottom housing and an external torque transmission portion adapted to engage the internal torque transmission portion of the bottom housing;

a tubular release piston comprising an upper portion disposed within the tubular top housing, said upper portion comprising a first upper portion having a first outer diameter, a second upper portion proximate the first upper portion and having a second outer diameter less than the first outer diameter, and a valve seat, the piston adapted to translate longitudinally within the top housing along the central longitudinal axis from a locked position to an unlocked position; and a shear sleeve disposed within the tubular top housing and attached to the tubular release piston, said shear sleeve adapted to secure the tubular release piston in the locked position and to disconnect from the tubular release piston at a threshold force on the tubular release piston allowing the tubular release piston to translate along the central longitudinal axis to the unlocked position.

* * * * *